US007513985B2

(12) United States Patent
Moore

(10) Patent No.: US 7,513,985 B2
(45) Date of Patent: Apr. 7, 2009

(54) ELECTROCHEMICAL FLUORINATION OF ACRYLIC POLYMER AND PRODUCT THEREFROM

(75) Inventor: George G. I. Moore, Afton, MN (US)

(73) Assignee: 3M Innovative Properties Company, Saint Paul, MN (US)

( * ) Notice: Subject to any disclaimer, the term of this patent is extended or adjusted under 35 U.S.C. 154(b) by 592 days.

(21) Appl. No.: 11/252,265

(22) Filed: Oct. 17, 2005

(65) Prior Publication Data

US 2007/0084733 A1 Apr. 19, 2007

(51) Int. Cl.
*C25B 3/08* (2006.01)

(52) U.S. Cl. ..... 205/430

(58) Field of Classification Search ..... 524/543, 524/565; 526/242; 205/430
See application file for complete search history.

(56) References Cited

U.S. PATENT DOCUMENTS

| | | | | |
|---|---|---|---|---|
| 2,519,983 | A | | 8/1950 | Simons |
| 2,567,011 | A | | 9/1951 | Diesslin et al. |
| 3,028,321 | A | | 4/1962 | Danielson et al. |
| 3,692,643 | A | | 9/1972 | Holland |
| 3,753,976 | A | | 8/1973 | Grass et al. |
| 3,957,596 | A | | 5/1976 | Seto |
| 4,086,407 | A | | 4/1978 | Fozzard |
| 4,139,447 | A | | 2/1979 | Faron et al. |
| 4,203,821 | A | | 5/1980 | Cramer et al. |
| 4,406,768 | A | | 9/1983 | King |
| 4,739,103 | A | | 4/1988 | Hansen et al. |
| 4,950,370 | A | | 8/1990 | Tarancon |
| 5,322,597 | A | | 6/1994 | Childs et al. |
| 5,387,323 | A | | 2/1995 | Minday et al. |
| 5,616,794 | A | | 4/1997 | Behr et al. |
| 5,998,521 | A | * | 12/1999 | Fan et al. ..... 524/225 |
| 6,267,865 | B1 | | 7/2001 | Polson et al. |
| 6,391,182 | B2 | | 5/2002 | Smetzer et al. |
| 6,919,015 | B2 | | 7/2005 | Bauer et al. |

FOREIGN PATENT DOCUMENTS

| | | |
|---|---|---|
| EP | 0 455 399 A2 | 11/1991 |
| JP | 55-090508 | 7/1980 |
| JP | 55-151016 | 11/1980 |
| JP | 6-248014 | 9/1994 |
| JP | 2-30785 | 1/2002 |
| WO | WO 00/75092 A1 | 12/2000 |

OTHER PUBLICATIONS

Burdon et al., "The Electrochemical Process for the Synthesis of Fluoro-Organic Compounds", in "Advances in Fluorine Chemistry", vol. 1, Stacey et al., eds., Butterworths Scientific Publications, London, 1960, pp. 129-137, no month.

Rudge, "Electrochemical Fluorination", (Chapter 1) in "Industrial Electrochemical Processes", A. T. Kuhn, ed., Elesvier Publishing Company, Amsterdam, 1971, pp. 71-75, no month.

W. V. Childs et al., "Anodic Fluorination" (Chapter 26) in "Organic Electrochemistry, An Introduction and a Guide", H. Lund et al., eds., Marcel Dekker Inc., New York, 1991, pp. 1103-1127, no month.

Abe et al., "Electrochemical Fluorination (Simons Process) as a Route to Perfluroinated Organic Compounds of Industrial Interest" (Chapter 1) in "Preparation, Properties and Industrial Applications of Organofluorine Compounds", Banks, et al., eds., Ellis Horwood Limited, England, 1982, pp. 19-43, no month.

J. H. Simons, "Fluorine Chemistry", Academic Press, New York, 1950, pp. 416-418, no month.

* cited by examiner

*Primary Examiner*—Edna Wong
(74) *Attorney, Agent, or Firm*—Bradford B. Wright

(57) ABSTRACT

Methods of electrochemically fluorinating an acrylate polymer, and products therefrom.

11 Claims, No Drawings

ELECTROCHEMICAL FLUORINATION OF ACRYLIC POLYMER AND PRODUCT THEREFROM

BACKGROUND

Fluorinated polymers are useful, for example, in the preparation of low surface energy and low refractive index coatings. In many cases, the fluorinated polymers have reactive groups such as alcohols that provide reactive sites for crosslinking reactions. Currently, such fluorinated polymers are generally prepared in commercial quantities using free-radical polymerization of corresponding fluorinated monomers. Such monomers are generally expensive and can be troublesome to obtain and/or handle. Further, in some cases it may be necessary to derivatize the resulting polymer in order to obtain the reactive groups.

One well-known industrial process for preparing fluorochemical compounds is the electrochemical fluorination process commercialized initially in the 1950's by the 3M Company. This process, often referred to as Simons fluorination or electrochemical fluorination (ECF), is a method by which electric current is passed through an electrolyte solution containing a mixture of liquid anhydrous hydrogen fluoride and an organic compound intended to be fluorinated (the "substrate"). Generally, the Simons process is practiced with a constant current passed through the electrolyte. The current passing through the electrolyte causes one or more of the hydrogens of the substrate to be replaced by fluorine.

ECF has been used to make perfluoroalkanoyl fluorides, which have been of commercial value as precursors to carboxylic acids, esters, and alcohols. In general, ECF offers many advantages including relatively low cost and simplicity. However, as a general rule in electrochemical fluorination, the higher the molecular weight of the compound to be fluorinated, the greater the occurrence of breaking of carbon-carbon bonds. For example, as the molecular weight of the precursor $C_nH_{2n+1}COX$ (X=F or Cl) increases, the yields of $C_nF_{2n+1}COF$ decrease, as described by Abe et al. in Chapter 1 of *Preparation, Properties, and Industrial Applications of Organofluorine Compounds*, R. E. Banks, ed., pages 24-28, Halsted Press, New York (1982). In that case, the yields were as follows: n=1 (71% yield), n=3 (36% yield), n=6 (16% yield), n=7 (10% yield), n=11 (0.5% yield), n=15 (0% yield). In part, these lower yields are due to cleavage of the carbonyl group to give $C_nF_{2n+1}F$; in part due to reaction between the alkyl chain and the carbonyl oxygen, leading to 5- and 6-membered ether rings for n=4 and higher.

Hence, electrochemical production of fluorine-containing compounds has typically been applied to relatively low molecular weight compounds.

SUMMARY

In one aspect, the present invention provides a method of electrochemically fluorinating a polymer, the method comprising:

providing a hydrogen containing acrylate polymer comprising at least five monomeric units derived from one or more alkyl acrylates having from 1 to 4 carbon atoms;

combining the polymer with anhydrous hydrogen fluoride in an electrochemical fluorination cell to provide a reaction solution; and passing electric current through the electrochemical fluorination cell sufficient to cause replacement of at least a portion of the hydrogen with fluorine to provide a reaction product comprising at least one fluoropolymer that comprises a plurality of pendant

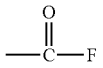

groups and is liquid, or soluble in perfluorohexane, at 20° C.

Surprisingly, it is discovered according to the present invention that electrochemical fluorination of polymers having monomeric units derived from at least one alkyl acrylate wherein the alkyl group has from 1 to 4 carbon atoms results in fluorinated oligomers and polymers having a plurality of pendant

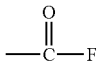

groups in commercially acceptable yields. The resulting polymers are typically suitable for making fluorinated coatings.

DETAILED DESCRIPTION

Useful hydrogen containing acrylate polymers have at least five monomeric units derived from one or more acrylate esters having from 1 to 4 carbon atoms. Examples of such acrylate esters include methyl acrylate, ethyl acrylate, n-propyl acrylate, isopropyl acrylate, n-butyl acrylate, sec-butyl acrylate, isobutyl acrylate, t-butyl acrylate, and combinations thereof.

In some embodiments, the acrylate polymer may further comprise at least one monomeric unit derived from acrylic acid or an acryloyl halide (e.g., acryloyl chloride or acryloyl fluoride). In some embodiments, the acrylate polymer may further comprise at least one monomeric unit derived from acrylonitrile.

As used herein, the term "acrylate polymer" refers to a polymer consisting essentially of monomeric units having an acryl (i.e., $H_2C{=}CH{-}C({=}O){-}$) group. That is, other monomeric units may be present, but only if their presence does not have a material effect on the ECF process (e.g., by causing degradation). For example, significant amounts of monomeric units derived from methacrylate esters are generally excluded as such amounts typically cause polymer chain degradation.

In general, the molecular weight of the polymer number average molecular weight should be low enough that current blocking does not occur. For example, the weight average molecular weight may be less than about 50,000 grams per mole, or even less than 28,000 grams per mole.

Methods for making hydrogen containing acrylate polymers of such molecular weights are widely known (e.g., by free-radical polymerization). Molecular weight control may be achieved, for example, by use of chain transfer agents, such as thiols and secondary alcohols, and by higher polymerization temperatures, and combinations thereof. In addition, many such acrylate polymers are commercially available.

ECF is generally carried out in an electrochemical cell having at least two nickel electrodes. Generally, any ECF process can be used to fluorinate the hydrogen containing acrylate polymer. Examples of suitable ECF processes include, the Simons electrochemical fluorination process (e.g., as described hereinbelow), the interrupted current process described in U.S. Pat. No. 6,267,865 (Polson et al.) and the bipolar flow cell described in U.S. Pat. No. 5,322,597 (Childs et al.), the disclosures of which are incorporated herein by reference.

The Simons electrochemical fluorination (Simons ECF) process was commercialized initially in the 1950s by Minnesota Mining and Manufacturing Company. This ECF process comprises passing a direct electric current through an electrolyte, (i.e., a mixture of fluorinatable organic starting compound, liquid anhydrous hydrogen fluoride, and optionally a conductivity additive), to produce the desired fluorinated compound or fluorochemical. Simons ECF cells typically utilize a monopolar electrode assembly, i.e., electrodes connected in parallel through electrode posts to a source of direct current at a low voltage (e.g., four to eight volts). Simons ECF cells are generally undivided, single-compartment cells, i.e., the cells typically do not contain anode or cathode compartments separated by a membrane or diaphragm. The Simons ECF process is disclosed in U.S. Pat. No. 2,519,983 (Simons), the disclosure of which is incorporated herein by reference, and is also described in some detail by J. Burdon and J. C. Tatlow in *Advances in Fluorine Chemistry*, Stacey et al., eds., Volume 1, pages 129-37, Buttersworths Scientific Publications, London (1960); by A. J. Rudge in *Industrial Electrochemical Processes*, A. T. Kuhn, ed., pages 71-75, Marcel Dekker, Inc., New York (1967).

Simons ECF can be carried out essentially as follows. A starting material and an optional conductivity additive are dispersed or dissolved in anhydrous hydrogen fluoride to form an electrolytic "reaction solution." One or more anodes and one or more cathodes are placed in the reaction solution and an electric potential (voltage) is established between the anode(s) and cathode(s), causing electric current to flow between the cathode and anode, through the reaction solution, and resulting in an oxidation reaction (primarily fluorination, i.e., replacement of one or more carbon-bonded hydrogens with carbon-bonded fluorines) at the anode, and a reduction reaction (primarily hydrogen evolution) at the cathode. As used herein, "electric current" refers to electric current in the conventional meaning of the phrase, the flow of electrons, and also refers to the flow of positively or negatively charged chemical species (ions). The Simons ECF process is well known, and the subject of numerous technical publications such as, for example, on pages 416-418 of Vol. 1 of *Fluorine Chemistry*, edited by J. H. Simons, Academic Press, Inc., New York (1950); and in U.S. Pat. No. 5,322,597 (Childs et al.) and U.S. Pat. No. 5,387,323 (Minday et al.), the disclosures of which are incorporated herein by reference, each of which refer to the Simons ECF process and Simons ECF cell.

Generally the Simons ECF process is practiced with a constant current passed through the electrolyte; i.e., a constant voltage and constant current flow; see, for example, W. V. Childs et al. in *Anodic Fluorination* (*Chapter* 26) in *Organic Electrochemistry*, H. Lund and M. Baizer eds., pages 1103-1127, Marcel Dekker Inc., New York (1991). The current passing through the electrolyte causes one or more of the hydrogens of the starting material to be replaced by fluorine. Perfluorination is the usual outcome.

Various modifications and/or improvements have been introduced to the Simons ECF process since the 1950s including, but not limited to, those described in U.S. Pat. No. 3,753,976 (Voss et al.); U.S. Pat. No. 3,957,596 (Seto); U.S. Pat. No. 4,203,821 (Cramer et al.); U.S. Pat. No. 4,406,768 (King); U.S. Pat. No. 4,139,447 (Faron et al.); and U.S. Pat. No. 4,950,370 (Tarancon); the disclosures of which are incorporated herein by reference.

Another useful electrochemical fluorination cell includes the type generally known in the electrochemical fluorination art as a flow cell. Flow cells comprise a set (one of each), stack, or series of anodes and cathodes, where reaction solution is caused to flow over the surfaces of the anodes and cathodes using forced circulation. These types of flow cells are generally referred to as monopolar flow cells (having a single anode and a single cathode, optionally in the form of more than a single plate, as with a conventional electrochemical fluorination cell), and, bipolar flow cells (having a series of anodes and cathodes).

U.S. Pat. No. 5,322,597 (Childs et al.), the disclosure of which is incorporated herein by reference, describes the practice in a bipolar flow cell of an electrochemical fluorination process comprising passing by forced convection a liquid mixture comprising anhydrous hydrogen fluoride and fluorinatable organic compound at a temperature and a pressure where a substantially continuous liquid phase is maintained between the electrodes of a bipolar electrode stack. The bipolar electrode stack comprises a plurality of substantially parallel, spaced-apart electrodes made of an electrically conductive material, e.g., nickel, which is essentially inert to anhydrous hydrogen fluoride and when used as an anode, is active for electrochemical fluorination. The electrodes of the stack are arranged in either a series or a series-parallel electrical configuration. The bipolar electrode stack has an applied voltage difference that produces a direct current that can cause the production of fluorinated organic compound.

Generally, in the ECF process, a reaction solution is prepared that comprises hydrogen fluoride and a hydrogen-containing acrylate polymer. The hydrogen fluoride is typically anhydrous hydrogen fluoride, meaning that it contains at most only a minor amount of water, e.g., less than about 1 weight percent (wt %) water, more typically less than about 0.1 weight percent water. The reaction solution within the ECF cell includes an electrolyte phase comprising HF and an amount of hydrogen-containing acrylate polymer at least partially dissolved or dispersed therein. If desired, the acrylate polymer may be introduced to the cell as a solute dissolved in HF or a lower alkyl ester, such as ethyl acetate. In this case the ethyl acetate becomes fluorinated.

The reaction solution is exposed to reaction conditions (e.g., temperature, pressure, electric voltage, electric current, and power) sufficient to cause fluorination of the starting material. Reaction conditions chosen for a particular fluorination process depend on factors such as the size and construction of the ECF cell, the composition of the reaction solution, the presence or absence of a conductivity additive, flow rate, etc.

The reaction temperature can be any temperature that allows a useful degree of fluorination of the acrylate polymer. The temperature may depend on the factors discussed in the preceding paragraph, as well as the solubility of the starting material and the physical state of the starting material or the fluorinated product.

The electricity passed through the reaction solution can be any amount that will result in at least partial fluorination, more typically perfluorination, of the acrylate polymer. The current level is typically chosen to minimize residual hydrogen atoms in the product, excessive fragmentation of the acrylate polymer, and/or the liberation of fluorine gas during fluorination.

As a result of the inventive process the acrylate polymer is converted to a reaction product comprising at least one fluoropolymer that comprises a plurality of pendant

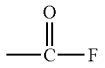

groups. Advantageously, the fluoropolymer is liquid, or is soluble in perfluorohexane, at 20° C., which facilitates cleanliness of the ECF cell and isolation of the reaction product. In view of the Abe et al. publication, discussed hereinabove, the ECF yields obtained according to the present invention are surprisingly good; for example, yields of 20-30 percent may be achieved). At least in some cases, $^{19}$F-NMR of the ECF reaction product indicates a complex mixture which includes —COF, cyclic ether, and —$OCF_3$ groups. The retention of the ester methyl group is unprecedented.

At least a portion of the ECF reaction product may be isolated using conventional techniques such as for example, draining periodically during the ECF process. Additional acrylate polymer may be added to the cell as a solution in HF or in a sacrificial solvent such as, for example, ethyl acetate.

Further details concerning ECF may be found in, for example, U.S. Pat. No. 5,616,794 (Behr et al.); U.S. Pat. No. 6,267,865 (Polson et al.); U.S. Pat. No. 6,919,015 (Bauer et al.); and U.S. Pat. No. 6,391,182 (Smeltzer et al.); the disclosures of which are incorporated herein by reference.

If desired, one or more diluents may be present in the reaction mixture. Examples of suitable diluents include, for example, perfluorohexane, perfluorooctane, and related perfluorinated liquids such as 3M Company's FC-75 and combinations thereof.

Optionally, one or more conductivity additives are present in the reaction mixture to ensure adequate current flow. Examples of suitable conductivity additives include sodium fluoride, acetic anhydride, organic sulfur-containing additives such as that described in U.S. Pat. No. 3,028,321 (Danielson); U.S. Pat. No. 3,692,643 (Holland); and U.S. Pat. No. 4,739,103 (Hansen); the disclosures of which are incorporated herein by reference. Combinations of the foregoing additives may also be used. If desired, at least a portion of the pendant

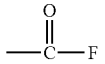

groups may be converted to other functional groups, such as, for example, amido groups (e.g., including alkylamido groups), carboxyl groups, hydroxyalkyl groups (e.g., methylol groups), aminoalkyl groups, or carboalkoxy groups.

Reaction products prepared according to the present invention can be converted into highly fluorinated crosslinking agents useful, for example, for preparing low surface and low refractive index energy coatings. For example, the —C(=O)F groups can be reacted with hydroxyethyl acrylate or sequentially reduced to the corresponding carbinol and acrylated or reacted with aminoethanol and acrylated to produce free-radically crosslinkable coating compositions. The polyol intermediates can be reacted with di- or poly-isocyanates to produce crosslinked coatings.

Objects and advantages of this invention are further illustrated by the following non-limiting examples, but the particular materials and amounts thereof recited in these examples, as well as other conditions and, details, should not be construed to unduly limit this invention.

EXAMPLES

Unless otherwise noted, all parts, percentages, ratios, etc. in the examples and the rest of the specification are by weight, and all reagents used in the examples were obtained, or are available, from general chemical suppliers such as, for example, Sigma-Aldrich Company, Saint Louis, Mo., or may be synthesized by conventional methods. $M_n$ represents number average molecular weight and $M_w$ represents molecular weight.

Solubility in HF Test

A shaker table was loaded with polymer samples (typically 2-10 g) and anhydrous HF (10-20 mL) in 125 mL polyethylene bottles and screened for solubility after 24 hours.

This technique revealed that poly(methyl acrylate), $M_w$=120,000 g/mol was soluble. The rate of solubilization was improved by first heating the polymer into solution in ethyl acetate.

Preparation of Poly(methyl acrylate) Solution (PMA 1)

A 3-L round bottom flask fitted with a condenser, overhead stirrer and nitrogen atmosphere was charged with 286.5 g of methyl acrylate, 20.0 g of methyl-3-mercapto propionate, 2.45 g of 2,2'-azobis(2-methylbutyronitrile) commercially available under the trade designation "VAZO 67" from E. I. du Pont de Nemours and Co., Wilmington, Del., and 1221 g of ethyl acetate. The contents of the flask were heated at reflux under nitrogen for 48 hours. The preceding procedure was repeated, and the two products were combined and concentrated on a rotary evaporator to yield 1124.3 g of poly(methyl acrylate) at 51.6 percent solids in ethyl acetate (PMA 1); $M_n$=1440 g/mole; $M_w$=3250 g/mole.

Preparation of Poly(methyl acrylate) Solution (PMA 2)

A 3-L round bottom flask fitted with a condenser, overhead stirrer and nitrogen atmosphere was charged with 650 g of methyl acrylate, 650 g of toluene, 650.0 g of isopropanol, 1.5 g of 2,2'-azobis(2-methylbutyronitrile) commercially available under the trade designation "VAZO 67" from E. I. du Pont de Nemours and Co. The contents of the flask were heated at reflux under nitrogen for 20 hours. Solvent was removed by stripping on a rotary evaporator and then heating to about 120° C. at 1 torr (130 Pa), leaving 488.0 g of poly (methyl acrylate); $M_n$=3890 g/mole; $M_w$=20,600 g/mole. Of this, 90.1 g was dissolved in ethyl acetate to at 64.8 percent solids (PMA 2).

Preparation of Poly(methyl acrylate) Solution (PMA 3)

A 3-L round bottom flask fitted with a condenser, overhead stirrer and nitrogen atmosphere was charged with 500.0 g of methyl acrylate, 1.5 g of 2,2'-azobis(2-methylbutyronitrile) commercially available under the trade designation "VAZO 67" from E. I. du Pont de Nemours and Co., and 2000 g of ethyl acetate. The contents of the flask were heated at reflux under nitrogen for 24 hours. Upon cooling, 2408.2 g of poly (methyl acrylate), 19.3 percent solids in ethyl acetate (PMA 3), was decanted from the mixture; $M_n$=24,600 g/mole; $M_w$=373,000 g/mole.

Electrochemical Fluorination (ECF) Procedure

The equipment and operating procedure used in the electrochemical fluorination process are described in U.S. Pat. No. 2,567,011 (Diesslin et al.), the disclosure of which is incorporated herein by reference. Representative photographs of a 50-ampere laboratory cell appear on pages 417-418 of the book "Fluorine Chemistry", edited by J. H. Simons, Academic Press, New York (1950). The electrode pack had an alternating assemblage of nickel plates as cathodes and nickel plates as anodes, spaced apart a distance of ⅛ inch (0.32 cm) to ¼ inch (0.64 cm), the total effective anode surface area being about 0.68 $ft^2$ (632 $cm^2$). The cell was operated in a temperature range of 50° C.-65° C. and a pressure range of 25-40 psi (172-276 kPa). The applied D.C. cell voltage was in the range of 5-8 volts.

Example 1

A 3-L ECF cell as described in the ECF Procedure (above) was equipped with a 100-ampere power source, a syringe pump for the poly(methyl acrylate) solution, and a piston pump for fluorochemical liquid. The ECF cell was charged with anhydrous PM1 solution (51.6 percent in ethyl acetate) added at a rate of 4.7 mL/hr, delivering a total of 1034 mL (approximately 1124 g) over 218.6 hours. The fluorochemical liquid, available under the trade designation "FC-77" from 3M Company, St. Paul, Minn., was simultaneously added at a rate of 6.4 g/hr delivering a total of 1403 g. The cell was operated at 57° C., 35 psig (240 kPa), and 6.5 volts in the pulsed current mode (on 36 seconds, off 4). Liquid fluorochemical (946 g) was allowed to drain into a decanter below the cell body. This solution was stored over NaF for several days, filtered into a round bottom flask and stripped of solvent using a rotary evaporator at 60° C. and 20 torr (2.7 kPa), resulting in a clear, colorless viscous liquid (167.2 g, FP1), with a strong infrared absorption at 1876 $cm^{-1}$ (C(═O)F).

FP1 (10 g) was dissolved in 50 mL of $C_4F_9OCH_3$ and added to a stirred mixture of 1.9 g of $NaBH_4$ in 80 mL dry glyme. After 4 hours, an aliquot was washed with dilute HCl to yield an oil with no C═O absorption and strong —OH absorption centered at 3350 $cm^{-1}$. Workup with dilute HCl yielded 7.5 g of pale tan oil.

Example 2

The procedure of Example 1 was essentially followed with the exception that 246.0 g of PMA 2 and 95.0 g of fluorinated liquid (FC-77) were added over 67 hr.

An in-process sample was stripped on a rotary evaporator to yield 30.6 g of light tan viscous resin (FP2).

An aliquot portion was shaken with methanol containing 14 percent $BF_3$ to yield the methyl ester (FP3). $^{19}$F-NMR analysis revealed a complex structure with carbomethoxy ($COOCH_3$) functionality, fluorinated cyclic ethers, and fluorinated methoxy groups.

3.0 g of FP2 was dissolved in $C_4F_9OCH_3$ and treated with first 1.0 g hydroxyethyl acrylate, and then 1.0 g of ethyldiisopropylamine. The resulting ester was washed well with water, dried, and redissolved in $C_4F_9OCH_3$ and filtered of some insoluble material, stripped to give a tan oil.

Comparative Example 1

The procedure described for Example 1 was followed with the exception that PMA 3 was used as feed material. Cell operation was difficult, with current blocking associated with insoluble fluorinated products. The reaction yielded 32.8 g of a non-volatile liquid material.

Various modifications and alterations of this invention may be made by those skilled in the art without departing from the scope and spirit of this invention, and it should be understood that this invention is not to be unduly limited to the illustrative embodiments set forth herein.

What is claimed is:

1. A method of electrochemically fluorinating a polymer, the method comprising:

providing a hydrogen containing acrylate polymer comprising at least five monomeric units derived from one or more alkyl acrylates having from 1 to 4 carbon atoms;

combining the polymer with anhydrous hydrogen fluoride in an electrochemical fluorination cell to provide a reaction solution; and passing electric current through the electrochemical fluorination cell sufficient to cause replacement of at least a portion of the hydrogen with fluorine to provide a reaction product comprising at least one fluoropolymer that comprises a plurality of pendant

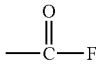

groups and is liquid, or soluble in perfluorohexane at 20° C.

2. A method according to claim 1, further comprising isolating at least a portion of the reaction product.

3. A method according to claim 2, further comprising reducing at least one of the pendant

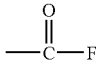

groups.

4. A method according to claim 1, wherein the polymer has a number average molecular weight of less than 50,000 grams per mole.

5. A method according to claim 1, wherein the polymer has a number average molecular weight of less than 28,000 grams per mole.

6. A method according to claim 1, wherein the one or more alkyl acrylates comprises methyl acrylate.

7. A method according to claim 1, wherein the polymer further comprises at least one monomeric unit derived from acrylic acid or acryloyl halide.

8. A method according to claim 1, wherein the polymer further comprises at least one monomeric unit derived from acrylonitrile.

9. A method according to claim 1, further comprising combining a conductivity additive comprising sulfur with the polymer and the anhydrous hydrogen fluoride.

10. A method according to claim 1, further comprising converting at least one of the pendant

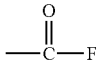

groups to another functional group.

11. A method according to claim 1, further comprising converting al least one of the pendant

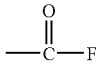

groups to a methylol group.

* * * * *

UNITED STATES PATENT AND TRADEMARK OFFICE

CERTIFICATE OF CORRECTION

PATENT NO. : 7,513,985 B2
APPLICATION NO. : 11/252265
DATED : April 7, 2009
INVENTOR(S) : George G. I. Moore It is certified that error appears in the above-identified patent and that said Letters Patent is hereby corrected as shown below:

Column 8
Line 59, Claim 11, delete "al least" and insert -- at least -- in place thereof.

Signed and Sealed this

Twenty-ninth Day of September, 2009

David J. Kappos

David J. Kappos
*Director of the United States Patent and Trademark Office*